US010575634B1

(12) United States Patent
Antonelli

(10) Patent No.: US 10,575,634 B1
(45) Date of Patent: Mar. 3, 2020

(54) OVER AND UNDER CLOSET ROD AND SHELF SUPPORTS

(71) Applicant: Anthony Charles Antonelli, Pennsauken, NJ (US)

(72) Inventor: Anthony Charles Antonelli, Pennsauken, NJ (US)

( * ) Notice: Subject to any disclaimer, the term of this patent is extended or adjusted under 35 U.S.C. 154(b) by 0 days.

(21) Appl. No.: 16/381,228

(22) Filed: Apr. 11, 2019

(51) Int. Cl.
*A47B 61/00* (2006.01)
*A47G 25/06* (2006.01)

(52) U.S. Cl.
CPC ..... *A47B 61/003* (2013.01); *A47G 25/0692* (2013.01)

(58) Field of Classification Search
CPC .. A47B 61/003; A47B 96/06; A47G 25/0692; A47G 25/06; A47G 25/0678
USPC ..... 211/123, 105.1
See application file for complete search history.

(56) References Cited

U.S. PATENT DOCUMENTS 1,002,063 A * 8/1911 Jasper ..... A47K 10/04 211/123
1,644,503 A * 10/1927 Aumack ..... A47B 61/003 211/123
2,374,787 A * 5/1945 Spiegel ..... A47K 10/04 211/105.1
2,880,955 A * 4/1959 Mason ..... A47H 1/13 248/263
2,905,426 A * 9/1959 Ross ..... A47G 25/0692 248/264
3,302,800 A * 2/1967 Zdanowski ..... B65D 85/185 211/123
3,357,374 A * 12/1967 Smith ..... A47B 61/00 108/29
3,490,600 A * 1/1970 Vernon ..... A47F 5/12 248/220.41
3,561,609 A * 2/1971 Doherty ..... A47F 5/103 211/206
3,563,182 A * 2/1971 MacFarlane ..... A47B 61/003 108/29
3,865,336 A * 2/1975 Robertson ..... A47B 61/00 248/235
4,426,057 A * 1/1984 Nudo ..... A47B 61/003 108/29
4,671,419 A * 6/1987 Beverly ..... A47H 1/142 211/105.1
4,938,403 A * 7/1990 Cortelli ..... B60R 9/00 211/105.1
5,373,950 A * 12/1994 Marc ..... A47K 10/04 211/105.1
6,105,795 A * 8/2000 Terragni ..... A47G 25/02 211/100

(Continued)

*Primary Examiner* — Patrick D Hawn
(74) *Attorney, Agent, or Firm* — Norman E. Lehrer

(57) ABSTRACT

A closet rod and shelf arrangement that includes inwardly facing walls, outwardly facing walls, a plurality of shelves and a plurality of hanging rods. A closet rod and shelf support system is comprised of two different types of support members. The first support member is elongated and oval shaped with its upper end secured to outwardly facing walls and the second support member is the same size and shape as the lower end of the first members. The second support members can be attached to either the inwardly facing walls or the first support members. Shelves and rods are supported by the second support members.

1 Claim, 2 Drawing Sheets

(56) References Cited

U.S. PATENT DOCUMENTS

| | | | | |
|---|---|---|---|---|
| 6,131,213 | A * | 10/2000 | Sarff | A47K 3/003 211/105.1 |
| 6,257,425 | B1 * | 7/2001 | Liu | A47K 10/04 211/105.1 |
| 8,132,768 | B2 * | 3/2012 | Fernandez | A47B 96/06 248/254 |
| 8,783,474 | B2 * | 7/2014 | Kuhlman | B60N 3/02 211/113 |
| 8,905,247 | B2 * | 12/2014 | Artigues | A47F 5/0018 211/187 |
| 9,282,816 | B2 * | 3/2016 | Ahart | A47B 47/0091 |
| 9,661,920 | B2 * | 5/2017 | Ahart | A47B 47/0091 |
| 10,021,974 | B2 * | 7/2018 | Beuses | A47G 25/0692 |
| 10,077,009 | B2 * | 9/2018 | Horgen | B60R 11/06 |
| 10,441,078 | B1 * | 10/2019 | King | F16B 7/0446 |
| 2002/0148796 | A1 * | 10/2002 | Lin | A47B 61/003 211/123 |
| 2006/0169659 | A1 * | 8/2006 | Robinson | A47B 57/30 211/187 |
| 2008/0237162 | A1 * | 10/2008 | Lynch | A47B 47/00 211/90.01 |
| 2018/0055221 | A1 * | 3/2018 | Beuses | A47B 61/003 |

* cited by examiner

OVER AND UNDER CLOSET ROD AND SHELF SUPPORTS

BACKGROUND OF THE INVENTION

The present invention is directed toward a closet rod and shelf arrangement and, more particularly, toward a closet rod and shelf support system that can effectively support shelves and closet rods between spaced apart opposed vertical inside walls and between spaced apart vertical outside walls or combinations thereof and which is aesthetically pleasing. As used herein and as will become more apparent below, the term "walls" refers to both closet walls and cabinet walls that are located within a closet.

While not limited thereto, the present invention is particularly adapted to be used in bedroom closets which frequently include a plurality of shelves for holding folded clothes and the like and a plurality of rods for hanging clothes. In conventional arrangements, there is normally a single shelf that extends the width of the closet and is supported at its left and right sides and back by a 1 by 4 or 5-inch wooden board arranged horizontally. A closet rod is located under the shelf and is supported at its ends by rod holders mounted on the wooden boards that support the left and right sides of the shelf.

This conventional arrangement has worked for many years and is quite suitable for conventional closets that require only one upper shelf and one hanging rod under the shelf. However, more modern living makes better use of closet space by including various shelves and drawers and the like in closets and a variety of hanging rods of different heights off the floor for the hanging of clothes of different lengths.

These newer arrangements normally require special designs and hardware when it is desired to support a hanging rod beneath a shelf or drawer that does not include left and right vertical walls that are facing each other where rod end holders can be attached. When this is required, some arrangement must be jury rigged or designed for each individual case which may be time consuming and not particularly aesthetically pleasing.

There is, therefore, a need for a more universal or multipurpose closet rod and shelf support system that can effectively support shelves and closet rods between opposed vertical inside walls and between spaced apart vertical outside walls or combinations thereof and which is aesthetically pleasing.

SUMMARY OF THE INVENTION

The present invention is designed to overcome the deficiencies of the prior art discussed above. It is an object of the present invention to provide a closet rod and shelf support system that is easy to install and is aesthetically pleasing.

It is another object of the present invention to provide such a closet rod and shelf support system that can effectively support shelves and closet rods between opposed vertical inside walls (closet or cabinet walls) and between spaced apart vertical outside walls.

It is a still further object of the present invention to provide a universal closet rod and shelf support system that can effectively support shelves and closet rods between opposed vertical inside walls and between spaced apart vertical outside walls or combinations thereof and which can be used in a variety of different closet arrangements with ease of installation.

In accordance with the illustrative embodiments demonstrating features and advantages of the present invention, there is provided a closet rod and shelf arrangement that includes inwardly facing walls, outwardly facing walls, a plurality of shelves and a plurality of hanging rods. Also included is a closet rod and shelf support system which is comprised of two different types of support members. The first support members are elongated and oval shaped with their upper ends secured to the outwardly facing walls and the second support members are the same size and shape as the lower end of the first members. The second support members can be attached to either the inwardly facing walls or the first support members. Shelves and rods are supported by the second support members.

Other objects, features, and advantages of the invention will be readily apparent from the following detailed description of the preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENTS

Figure 1:
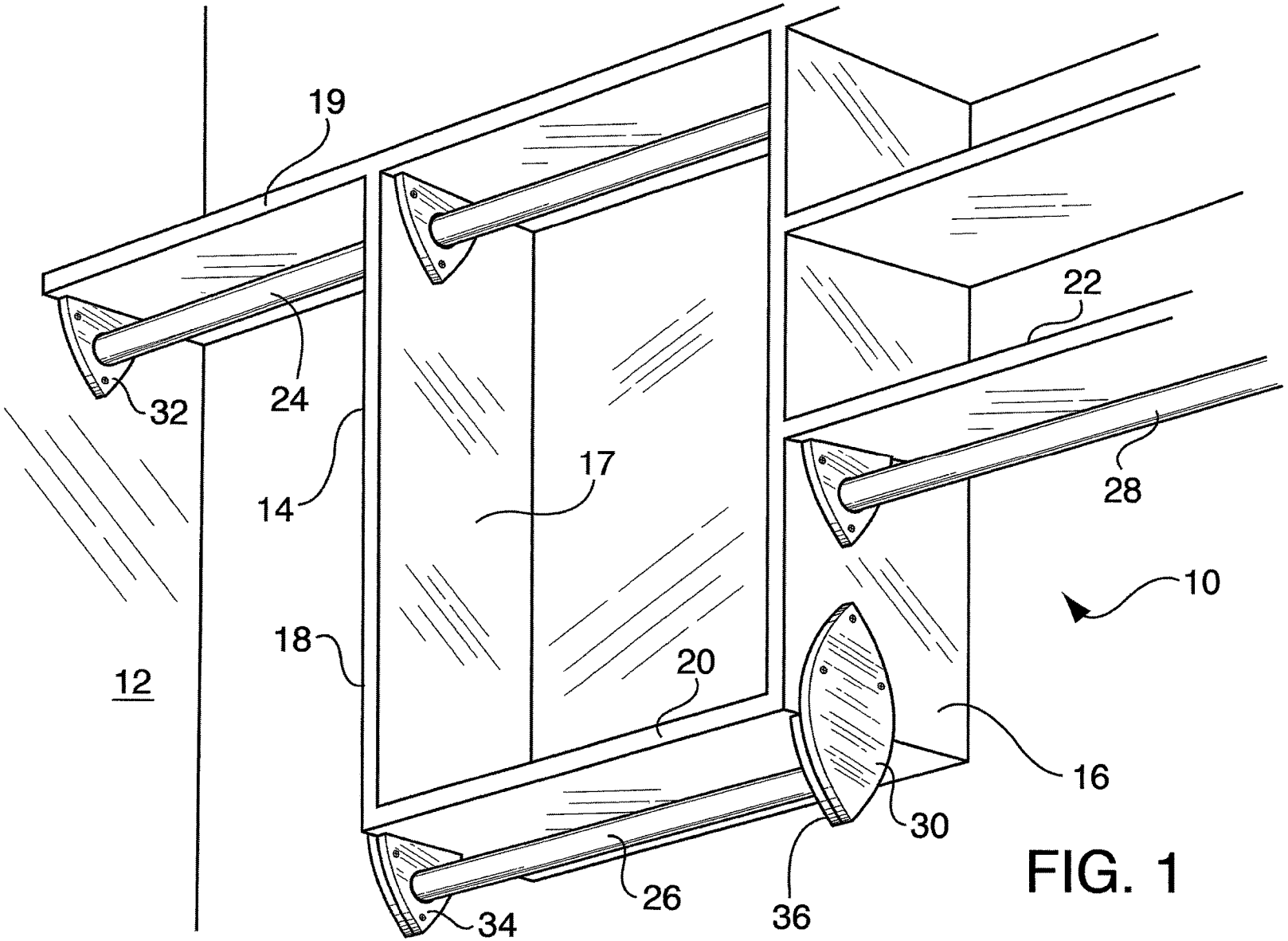
FIG. 1 is a front perspective view of a portion of a closet arrangement illustrating my invention.

Referring now to the drawings in detail wherein like reference numerals have been used throughout the various figures to designate like elements, there is shown in FIG. 1 a closet shelf and rod arrangement constructed in accordance with the principles of the present invention and designated generally as 10.

The closet shelf and rod arrangement 10 is comprised essentially of a plurality of spaced apart inwardly facing vertically extending walls such as the first inwardly facing wall 12 and the second inwardly facing cabinet wall 14. The term inwardly in this sense refers to walls that face each other. Also included are a plurality of outwardly facing walls such as the first outwardly facing wall 16 and the second outwardly facing wall 18. As used herein, the term outwardly facing walls refers to walls that face away from each other rather than toward each other.

In the embodiment of the invention shown in FIG. 1, the inwardly facing wall 14 and the outwardly facing wall 18 are, in fact, the same wall that is part of a suspended cabinet 17. With respect to wall 12, wall 14 is inwardly facing while, with respect to wall 16, wall 18 is an outwardly facing wall. It should be readily apparent, however, that there are a number of other inwardly and outwardly facing walls in the closet system.

Also included in the arrangement 10 is a plurality of shelves such as shown at 19, 20 and 22 and a plurality of hanging rods such as shown at 24, 26 and 28. The arrangement thus far described and as shown generally in FIG. 1 is not atypical of shelves and rods in a bedroom closet. It should be understood, however, that other arrangements are also possible. Furthermore, the system of the present invention is not limited to bedroom closets but can be used substantially anywhere that shelves and hanging rods are employed.

The arrangement 10 further includes a closet rod and shelf support system which includes a plurality of first support members such as shown at 30 and a plurality of second support members such as shown at 32, 34 and 36. Each of the second support members has a recess formed therein such as shown at 38 in FIG. 3 which is adapted to receive the end 40 of one of the rods such as rod 26 as shown in FIG. 3.

Each of the first support members such as member 30 is substantially oblong in shape with a height that is greater than its width and includes an upper half 42 and a lower half 44 which are substantially the same. By oblong, it is meant that the first support member 30 has rounded sides and is elongated. In the embodiment shown in the drawings, the first support member 30 has pointed ends. This is, however, by way of example only as the ends could also be rounded and fall within the definition of oblong.

Each of the second support members such as member 34 has a shape which is substantially the same as the lower half 44 of the first support member 30. However, each of the second support members includes a horizontal upper surface such as shown at 46 which is adapted to support a shelf thereon.

Figure 3:
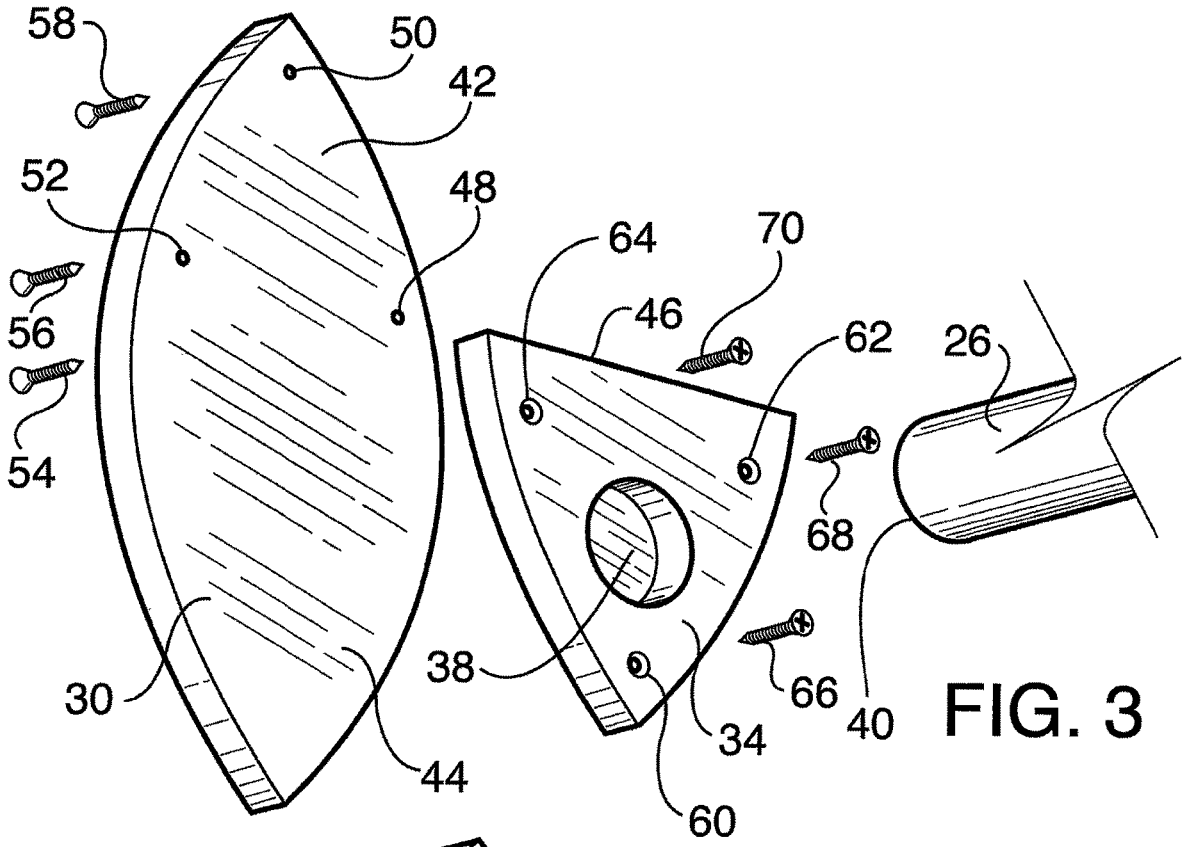
FIG. 3 is an exploded view of the support system of FIG. 2.
Figure 2:
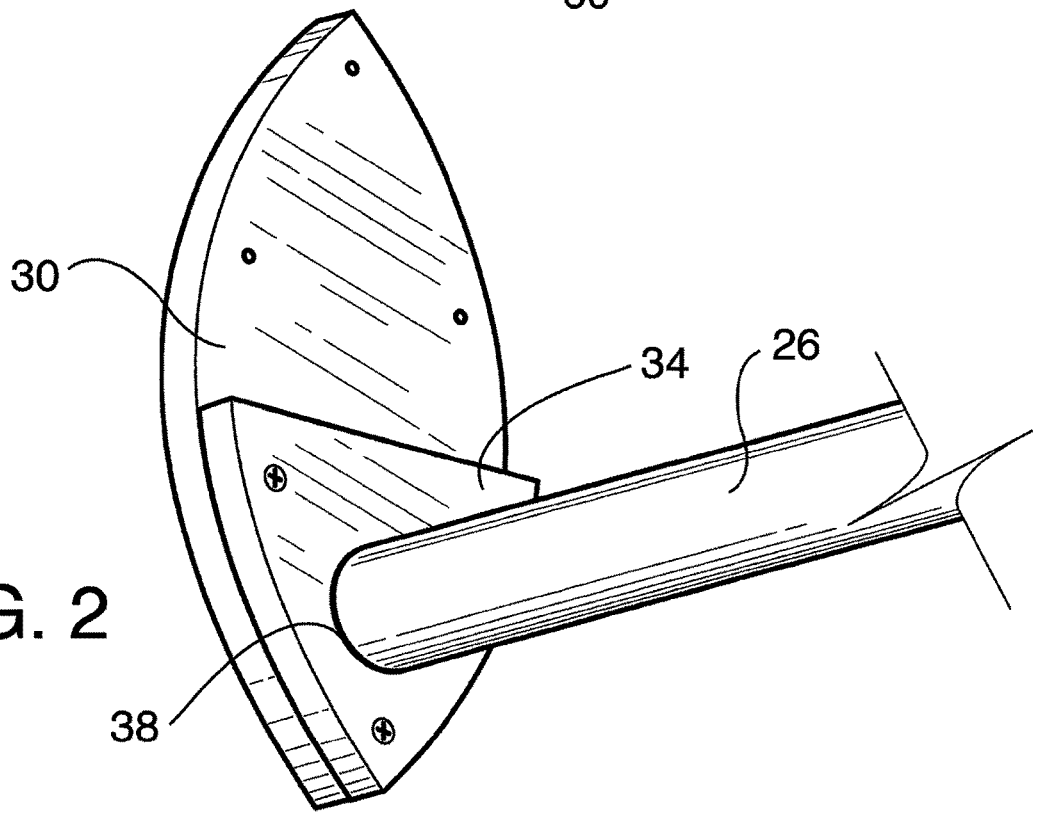
FIG. 2 is a front perspective view illustrating one of the support systems of the invention.

As shown most clearly in FIGS. 2 and 3, each of the first support members 30 includes a plurality of through-holes 48, 50 and 52 therein and a plurality of screws 54, 56 and 58 which allow the upper half 42 of the first support member 30 to be attached to an outer wall such as wall 16 as shown in FIG. 1. Similarly, each of the second support members such as member 34 includes a plurality of through-holes 60, 62 and 64 and a plurality of screws 66, 68 and 70 which allows the same to be attached either to an inner facing wall such as wall 12 or to the bottom 44 of one of the first support members 30 such as shown in FIG. 2.

In the embodiment shown, the first support members are preferably between 6 to 8 inches high and 3 to 5 inches wide while the second support members are half the size of the first support members as explained above. Preferably, the thicknesses of the first and second support members are the same and may be between about one half to an inch. These dimensions are, of course, by way of example only.

As best shown in FIG. 1, the first and second support members 30 and 32 are used in the following manner. A number of the second support members such as member 32 are secured to inwardly facing vertical walls to support a shelf thereabove and to support a rod between the two second support members. The upper halves of a pair of second support members are attached to a pair of outer facing walls such as 16 and 18 in FIG. 1 and have a pair of second support members secured to the bottom halves thereof. The pair of second support members 34 and 36 then help to support the shelf 20 and include a rod 26 extending therebetween.

The present invention may be embodied in other specific forms without departing from the spirit or essential attributes thereof and accordingly, reference should be made to the appended claims rather than to the foregoing specification as indicating the scope of the invention.

I claim:

1. A closet rod and shelf arrangement comprising:

first and second spaced apart inwardly facing vertically extending walls;

first and second spaced apart outwardly facing vertically extending walls;

a plurality of shelves and a plurality of rods;

a closet rod and shelf support system comprising a plurality of first support members and a plurality of second support members; each of said first support members having a substantially oblong shape with a height greater than its width and including an upper half and a lower half; each of said second support members having a shape which is substantially the shape of the lower half of said first support members but with a horizontal upper surface; each of said second support members having an exposed recess formed therein which is adapted to receive an end of one of said rods; each of said first and second support members having the same thickness which is less than said width;

one of said second support members being secured to said first inwardly facing wall and another one of said second support members being secured to said second inwardly facing wall;

a first shelf and a first rod supported by said one and said another one of said second support members;

the upper half of one of said first support members being secured to said first outwardly facing wall and the upper half of another one of said first support members being secured to said second outwardly facing wall; a third one of said second support members being secured to said one of said first support members and a fourth one of said second support members being secured to said another one of said first support members, and a second shelf and a second rod supported by said third and said fourth second support members.

* * * * *